US007658020B1

(12) United States Patent
Yun

(10) Patent No.: US 7,658,020 B1
(45) Date of Patent: Feb. 9, 2010

(54) EYESTAY ORNAMENT FOR FOOTWEAR

(75) Inventor: Ben Sy Yun, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 565 days.

(21) Appl. No.: 11/537,158

(22) Filed: Sep. 29, 2006

(51) Int. Cl.
*A43B 23/00* (2006.01)

(52) U.S. Cl. ..... 36/136

(58) Field of Classification Search ..... 36/136, 36/50.1

See application file for complete search history.

(56) References Cited

U.S. PATENT DOCUMENTS

| | | | | | |
|---|---|---|---|---|---|
| 3,671,974 | A * | 6/1972 | Sims | 2/421 |
| 4,597,198 | A | 7/1986 | Schweitzer | |
| 4,733,439 | A * | 3/1988 | Gentry | 206/338 |
| 4,958,459 | A * | 9/1990 | Davidson | 40/636 |
| 5,127,137 | A * | 7/1992 | Krauss | 24/265 R |
| 5,195,783 | A * | 3/1993 | Lavoie | 283/75 |
| D391,694 | S * | 3/1998 | Eichhorn | D30/153 |
| 5,740,557 | A | 4/1998 | Reid et al. | |
| 6,115,948 | A | 9/2000 | Mitchell | |
| 6,158,096 | A | 12/2000 | Bar | |
| 6,240,657 | B1 * | 6/2001 | Weber et al. | 36/50.1 |
| 6,434,870 | B1 * | 8/2002 | Fanjoy | 40/636 |
| 6,477,754 | B1 * | 11/2002 | Alexander | 24/712 |
| 6,626,132 | B1 * | 9/2003 | Mann | 119/795 |
| 7,325,337 | B2 * | 2/2008 | Cox et al. | 36/136 |
| 7,471,593 | B2 * | 12/2008 | Loring | 368/10 |
| 2002/0046476 | A1 | 4/2002 | Snyder | |
| 2004/0163285 | A1 | 8/2004 | Johnson | |
| 2004/0172853 | A1 | 9/2004 | Tonkel | |
| 2005/0016032 | A1 * | 1/2005 | Cox et al. | 36/136 |
| 2008/0086917 | A1 * | 4/2008 | Carrillo | 36/136 |

* cited by examiner

*Primary Examiner*—Marie Patterson
(74) *Attorney, Agent, or Firm*—Plumsea Law Group, LLC

(57) ABSTRACT

An eyestay ornament for a laced shoe provides a subtle but impressive way to add an aesthetic accent to the appearance of the shoe. A central marquee with multiple display faces is rotatably mounted to a pin captured in collars integrated to buckles on each end of the central marquee. The buckles are sized and designed to receive a shoe lace woven therethrough to install the ornament on the instep area. Rotating the central marquee provides a quick and easy way to change the appearance of the ornament.

15 Claims, 8 Drawing Sheets

EYESTAY ORNAMENT FOR FOOTWEAR

BACKGROUND OF THE INVENTION

1. Field of the Invention

This invention relates to an eyestay ornament for attaching to the eyestays or laces on footwear, and more particularly to an ornament having a pivotable mounting to enable the multi-sided marquee to be easily turned to display a different side and design.

2. Background of the Invention

Footwear has long served both functional and aesthetic purposes. Shoes and shoe laces have been the focus of designers in creating various aesthetic impressions. Athletic shoes in particular have also been the focus of creative designs using colors, textures, different materials to convey a desired visual impression. Many shoes also incorporate certain color combinations, trademarks, logos, numbers, and other indicia to communicate a brand, a source, a team affiliation, a famous athlete's name or jersey number, characters, or the like. All parts of athletic shoes including the shoe upper, midsole, outsole and the tongue and laces are used by designers to express a distinct impression and to present brand identifying logos or words.

The strong design emphasis on branded athletic footwear has resulted in some consumers' desire to contribute to the look of the shoes they are wearing, and in some manufacturers' desire to provide customizable features for the wearer. One category of prior art includes patents that disclose ways of changing the appearance of the shoe upper by way of changeable display panels or the like incorporated into the shoe uppers. For example, U.S. Patent Publication No. 2005/0016032 to Cox et al. discloses a changeable stripe for footwear that can be applied to any segment of a shoe. The changeable stripe enables the wearer to alter the appearance of the shoe. U.S. Pat. No. 6,115,948 to Mitchell discloses an insertable patch or emblem attached by way of hook and loop fasteners to the upper of a shoe to change the appearance of footwear as desired. Similarly, U.S. Pat. No. 5,740,557 to Reid et al. discloses a releasable magnetic display panel that can be attached to a shoe upper.

In laced shoes, the laced area allows the opening to spread for a wearer's foot to enter the shoe, and closes the opening about the foot to secure the shoe. In a laced shoe, a lace is inserted and generally woven back and forth through eyelets or eyestays disposed in opposing relation to one another across the opening. A tongue generally lays under the lace to protect the instep of the foot. In athletic shoes where a snug fit is desired, the tongue may have a stay disposed along its length for reception of a portion of the lace. Shoe designers have included the tongue and laces of a shoe in the overall design. For example, various color combinations of laces or uniquely designed eyelets or hidden eyelets have been used as part of athletic shoe designs.

Another category of prior art includes patents that are directed to features on the tongue or laces of a shoe to provide some variability in appearance. U.S. Patent Publication No. 2004/0172853 to Tonkel discloses a rotatable tongue for footwear that is attached by a pivot pin and presents various coloration and design on sections of the tongue. The rotatable tongue may be coupled with an upper having upper quarter openings to reveal more of the shoe tongue and present different designs. U.S. Pat. No. 6,158,096 to Bar discloses a separate shoe tongue positioner that secures the tongue of the shoe while providing a rigid base for an upper surface display. The base is mounted through the tongue of the shoe with tacks. U.S. Patent Publication No. 2004/0163285 to Johnson discloses a pouch that attaches to the top of the instep area to contain the ends of the shoelaces. The pouch can include a logo or design on the top surface. U.S. Pat. No. 4,597,198 to Schweitzer discloses an ornamental attachment for mounting on laced footwear having a flat face member display and a narrow strip of flexible sheet material extending underneath the flat face member. The laces of the shoe extend in the space between the display member and the strip of material. U.S. Pat. No. 4,958,459 to Davidson discloses elongated tubular members each having a frontal surface to display an alpha and/or numeric character or design. The tubular members are strung on the laces of footwear, and resemble beads which together can spell out a desired message with the frontal surfaces are decorated with letters. An alternative embodiment comprises a tubular body member with a frontal surface that extends laterally beyond the tubular portions. U.S. Patent Publication No. 2002/0046476 to Snyder discloses footwear having an elongated tongue that folds over the eyelet area and presents an upwardly facing surface. This surface of the tongue has a pocket with a transparent panel provided therein in which an indicia bearing card can be inserted. The card can present a team logo or identification information for the owner of the shoe. The appearance of the shoe of Snyder can be customized by changing the card in the pocket.

There is recognition in the prior art that people like to customize the appearance of their shoes, and in the case of athletic shoes, being able to alter coloration or change logos may be essential for team apparel. Some of the drawbacks of prior art attempts to provide customizable ornaments to shoes include (i) the use of specially designed shoes; (ii) the need to alter shoes; (iii) providing a single display surface; (iv) overly complex structures; or (v) time-consuming installation of the ornaments on shoes due to overly complex designs. There exists a need to provide a shoe ornament that is interchangeable from shoe to shoe; is simple to install on the shoe; provides multiple surfaces for displaying colors, logos, graphics or other indicia; and provides for easy change of display surfaces.

SUMMARY

The eyestay ornament of the present invention presents a subtle but impressive way to provide an aesthetic accent to the appearance of a laced shoe. One of the advantages of the present invention is that no alteration of the shoe itself is necessary making this eyestay ornament compatible with any and every laced shoe. This eyestay ornament can therefore be retrofit to any pair of shoes. The eyestay ornament of the present invention can be used with more than one pair of shoes allowing a wearer to transfer this particular design accent from shoe to shoe. Another advantage of the present invention is the number of design possibilities presented by the multi-sided marquee. Yet another advantage is the simple installation provided by the structure of the inventive eyestay ornament.

The eyestay ornament comprises attachment D-rings or buckles which are sized and designed to have shoe laces woven through them. Rotatably attached to the buckles is a central marquee having multiple sides to display various designs, logos, indicia or the like. The rotatable attachment of the marquee to the buckles is provided by a pair of pins, each extending outwardly at each end of the marquee being rotatably received in a collar integrally formed on each buckle. The collars are formed on the inside legs of the buckles, and provide rotatable support for the marquee. Once installed on the lace of a shoe, the marquee can be easily rotated to show the display surfaces that have different designs on them.

If the user wants to put the eyestay ornament on another pair of shoes, the ornament is simply taken off the laces of the first pair and put on the laces of the second pair. In this manner, the visual accent provided by the eyestay ornament can be consistently displayed on different shoes of a wearer. For athletic or other teams, this is a way to have a consistent visual design on each player's shoes without requiring all of the players to wear the same shoe model.

The rotation of the marquee provides an easy and quick way to change the appearance of the shoe and ornament without having to remove and reattach an ornament, carry another ornament, change a card in transparent window or the like.

Other configurations, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views. In the drawings.

DETAILED DESCRIPTION

Figure 1:
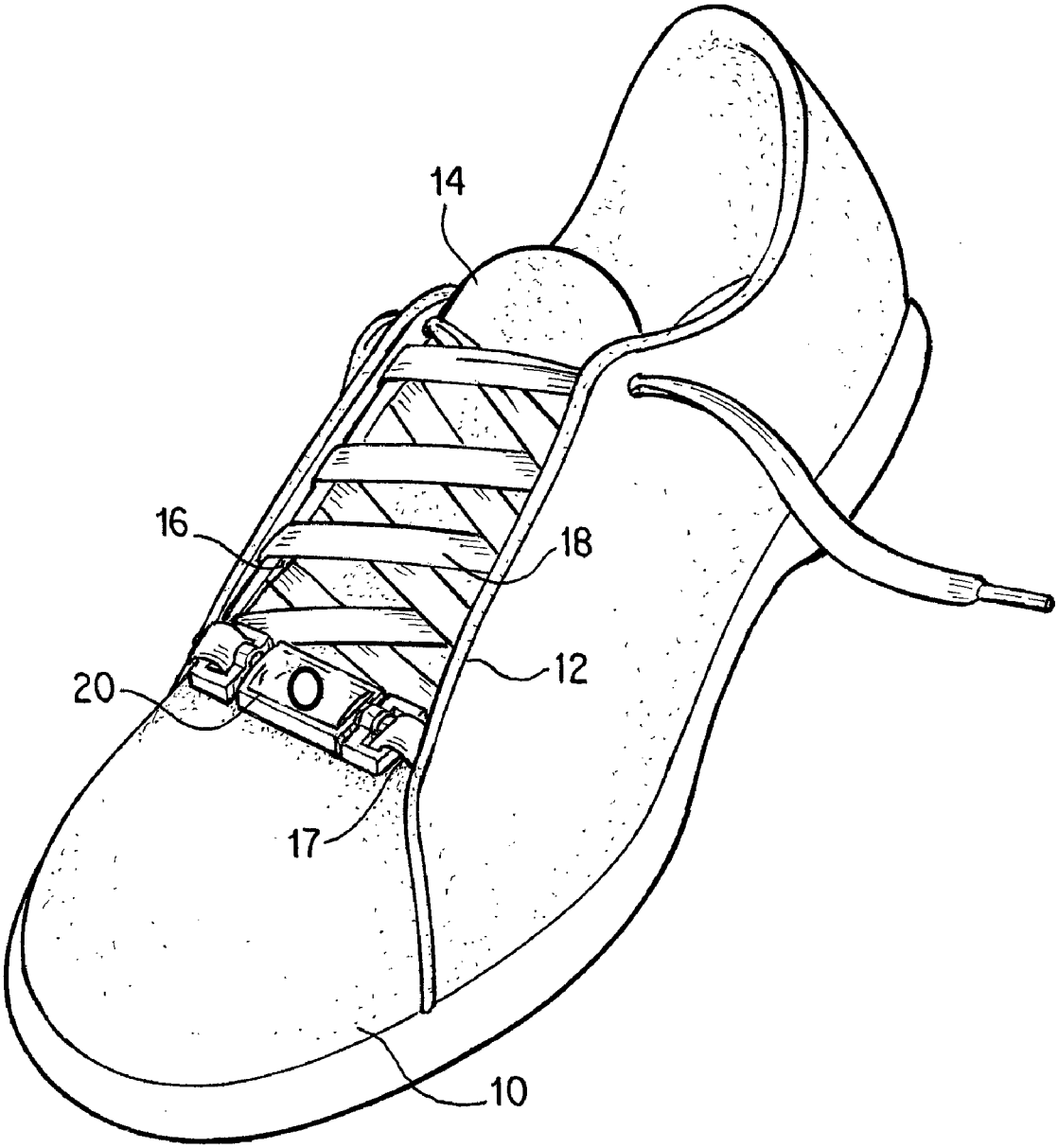
FIG. 1 is a perspective view of a shoe with an eyestay ornament attached to the bottommost pair of eyestays and showing one marquee side.
Figure 2:
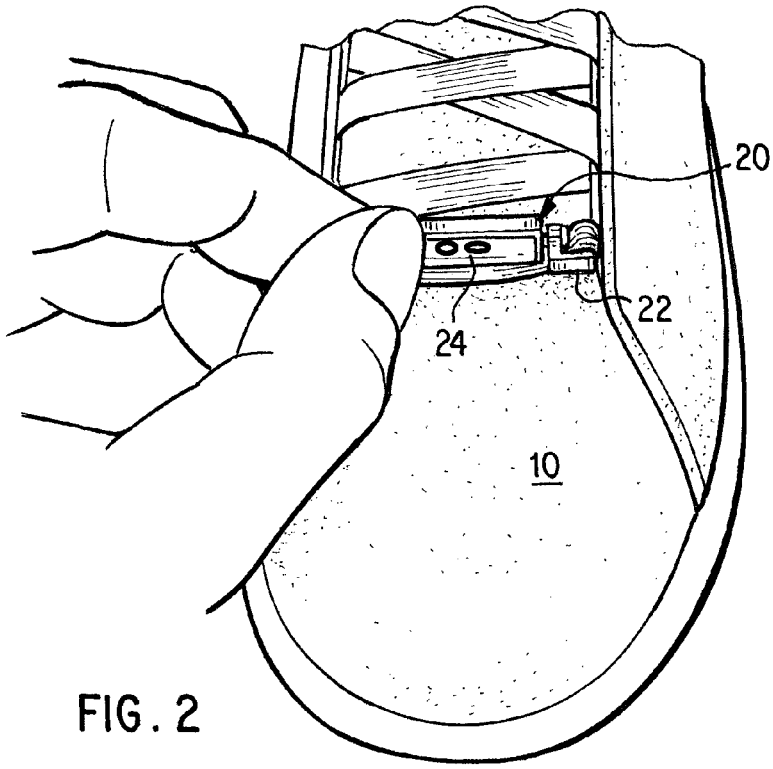
FIG. 2 shows the eyestay ornament being rotated to the opposite marquee side.
Figure 3:
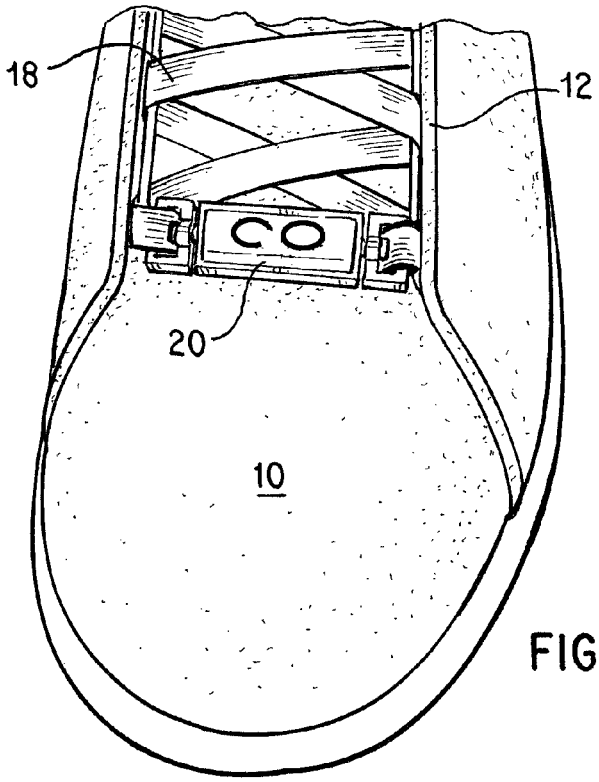
FIG. 3 is a plan view of the shoe with the eyestay ornament with the opposite marquee side showing.

A laced athletic shoe 10 has an opening 12 in the instep region with a tongue 14 covering the opening. Eyelets or lace stays 16 are provided along the edges of opening 12 to receive shoe lace 18 interlaced in eyelets 16 to extend across the tongue and close the opening about the foot of a wearer. The terms "eyelet," "lace stay" and "eyestay" are used interchangeably in this application to refer to the apertures or other features along the opening into which the shoe lace is woven. A bottommost pair of eyelets 17 is disposed at the forwardmost point of the opening in the forefoot area. In FIGS. 1-3, an eyestay ornament 20 is shown installed on the shoe lace proximate the bottommost stays 17. Eyestay ornament 20 comprises a pair of buckles 22 surrounding a central marquee 24. Marquee 24 has pivot pins 26 extending laterally outward and pins 26 are rotatably supported in collars 28 integrally formed on buckles 22. Pins 26 each have an enlarged end 30 to retain the pins in the collars. Of course eyestay ornament 20 could be installed on any pair of eyelets along the instep.

Eyestay ornament 20 is shown in FIG. 1 with central marquee 24 showing a first display face 24A. In FIG. 2, the central marquee is being rotated so that in FIG. 3 a second display face 24B of central marquee 24 is shown. For illustrative purposes only the first display face 24A has a single circle, and second display face 24B has a pair of circles. The pins of the central marquee enable rotation about the collars so that buckles 22 remain affixed to shoe lace 18. In this manner, central marquee 24 can display at least two different designs, logos, or the like to quickly and easily change the appearance thereof.

Figure 4:
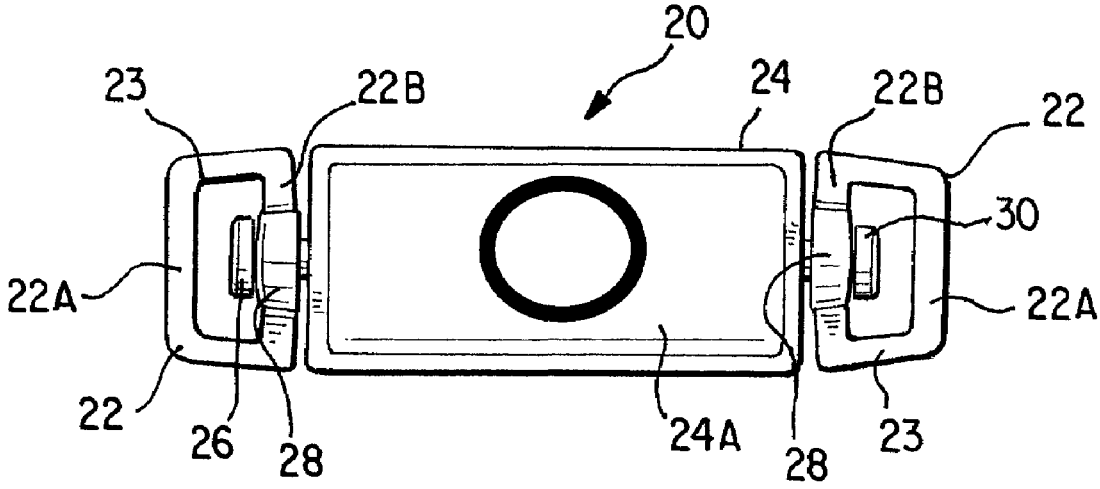
FIG. 4 is a plan view of the eyestay ornament shown in isolation showing one marquee side.
Figure 5:
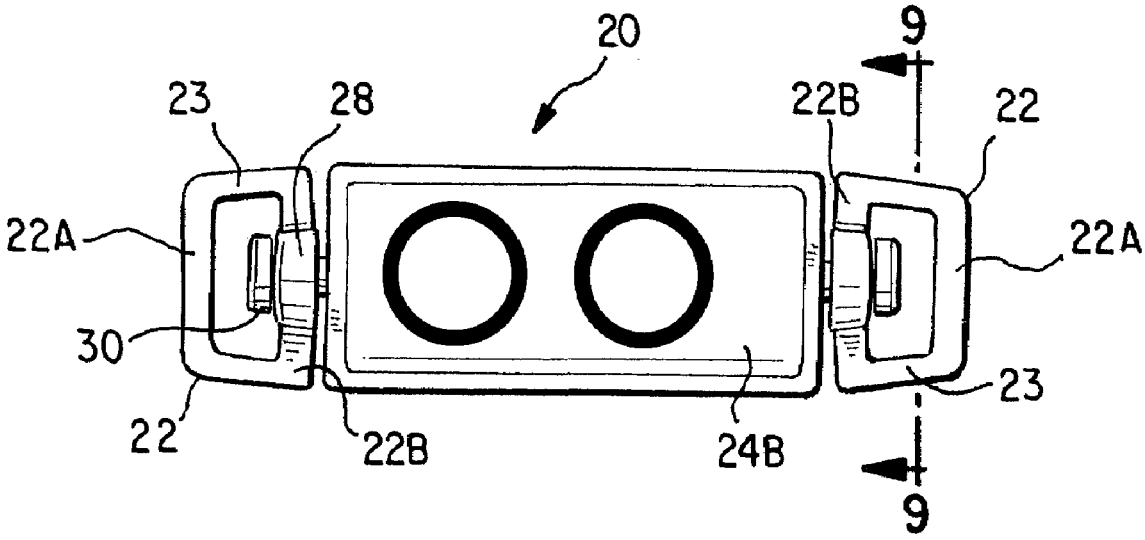
FIG. 5 is a plan view of the eyestay ornament of FIG. 4 showing the opposite marquee side.
Figure 6:
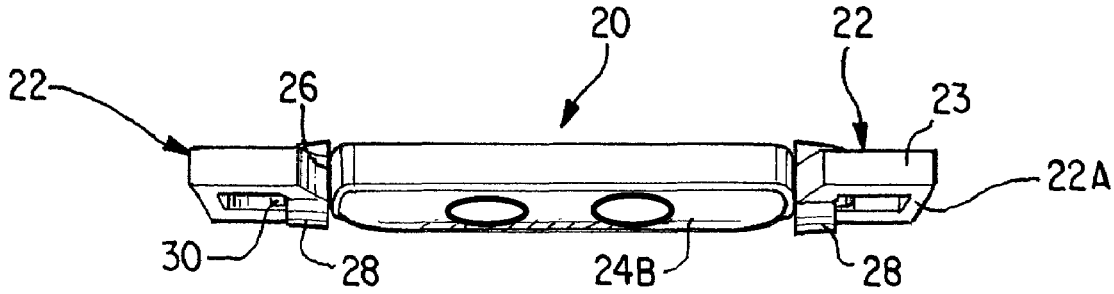
FIG. 6 is a front elevational view of the eyestay ornament of FIG. 4, the rear elevational view being a mirror image.
Figure 7:
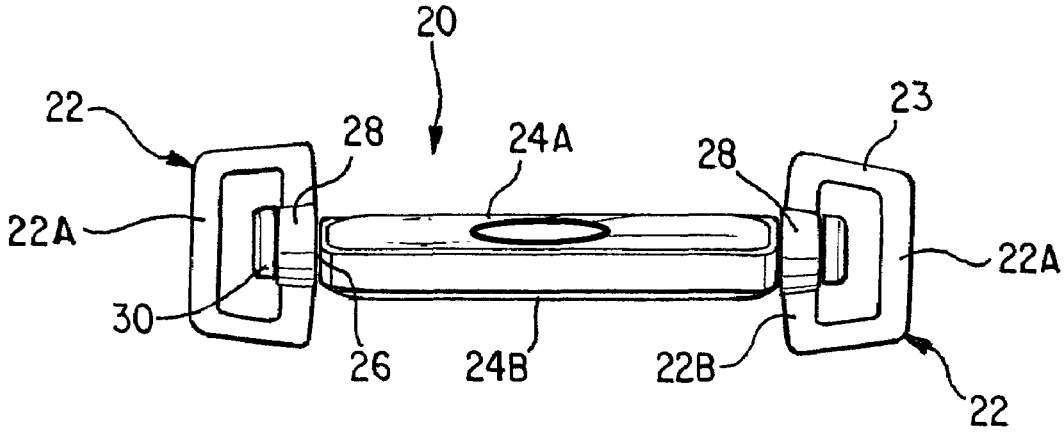
FIG. 7 is a front elevational view of the eyestay ornament of FIG. 4 shown with the marquee rotated out of plane.
Figure 8:
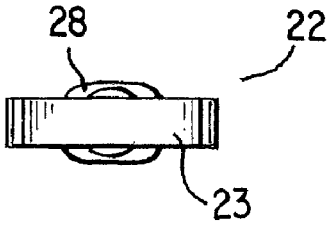
FIG. 8 is an end elevational view of the eyestay ornament of FIG. 4.

Eyestay ornament 20 is shown in isolation in FIGS. 4-9 for clarity. In the illustrated embodiment, first display face 24A of central marquee 24 contains a logo, and second display face 24B contains a name. These designs may be embossed, enameled, printed, etched, engraved or painted onto the display faces of central marquee 24. The two display faces of marquee 24 are shown in FIGS. 4-5. FIG. 6 illustrates a side elevational view of ornament 20, and FIG. 8 illustrates an end elevational view. These elevational views show that marquee 20 and buckles 22 are generally coplanar in the display position, and are of similar thicknesses in the illustrated embodiment. FIG. 7 is a plan view of the ornament shown with marquee 24 rotated out of plane similar to the position shown in FIG. 2.

Figure 9:
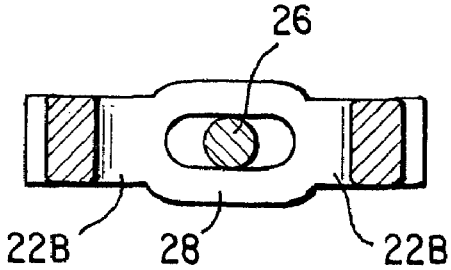
FIG. 9 is an enlarged sectional view taken along line 9-9 of FIG. 5 showing a sectional end view of the eyestay ornament.

Easy rotation of central marquee between the multiple display faces is enabled by the structure of the buckles and pivot pins. In the illustrated embodiment, central marquee 24 is rectangular with the longer sides forming the top and bottom edges, and the shorter sides forming the side edges. Extending laterally out of each of the side edges of central marquee 24 is a pivot pin 26. Each buckle 22 has an outer leg 22A and an inner leg 22B, both legs being generally parallel with a side edge of central marquee 24, and connected at the top and bottom by crosspieces 23. Each inner leg 22B has integrally formed therewith a collar 28 arranged to rotatably receive pin 26. As best seen in FIG. 9, collar 28 in the end view, is not circular, but rather is slightly elongated to enable free movement of pin 26 therein. Pin 26 is therefore captured in collar 28, and each pin 26 has an enlarged head 30 formed at the end to retain the pin within the collar. This ensures that the central marquee remains assembled to buckles 22.

Figure 10:
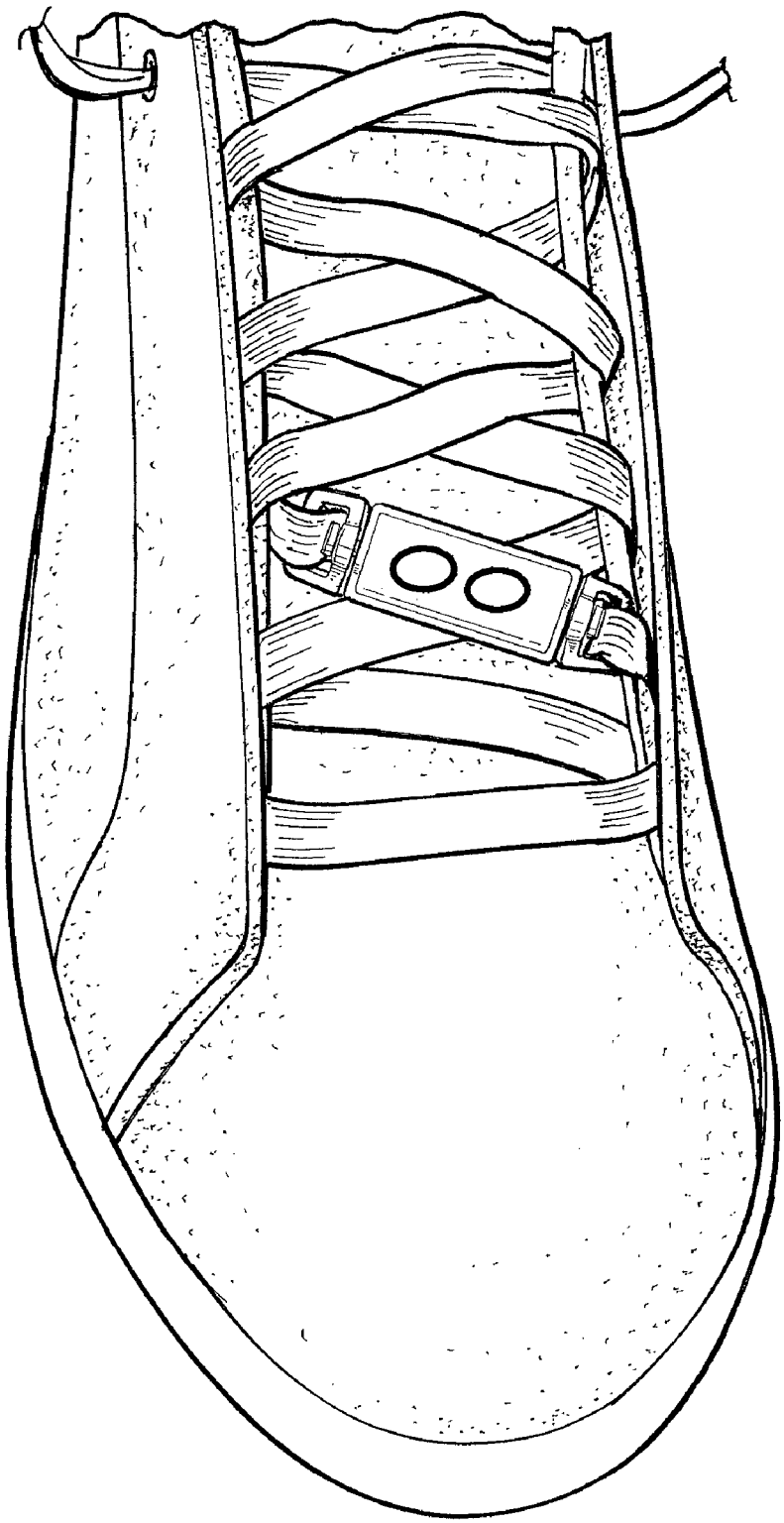
FIG. 10 is a plan view of a shoe with the eyestay ornament attached in a diagonal orientation spanning the eyelet area and showing one marquee side.
Figure 11:
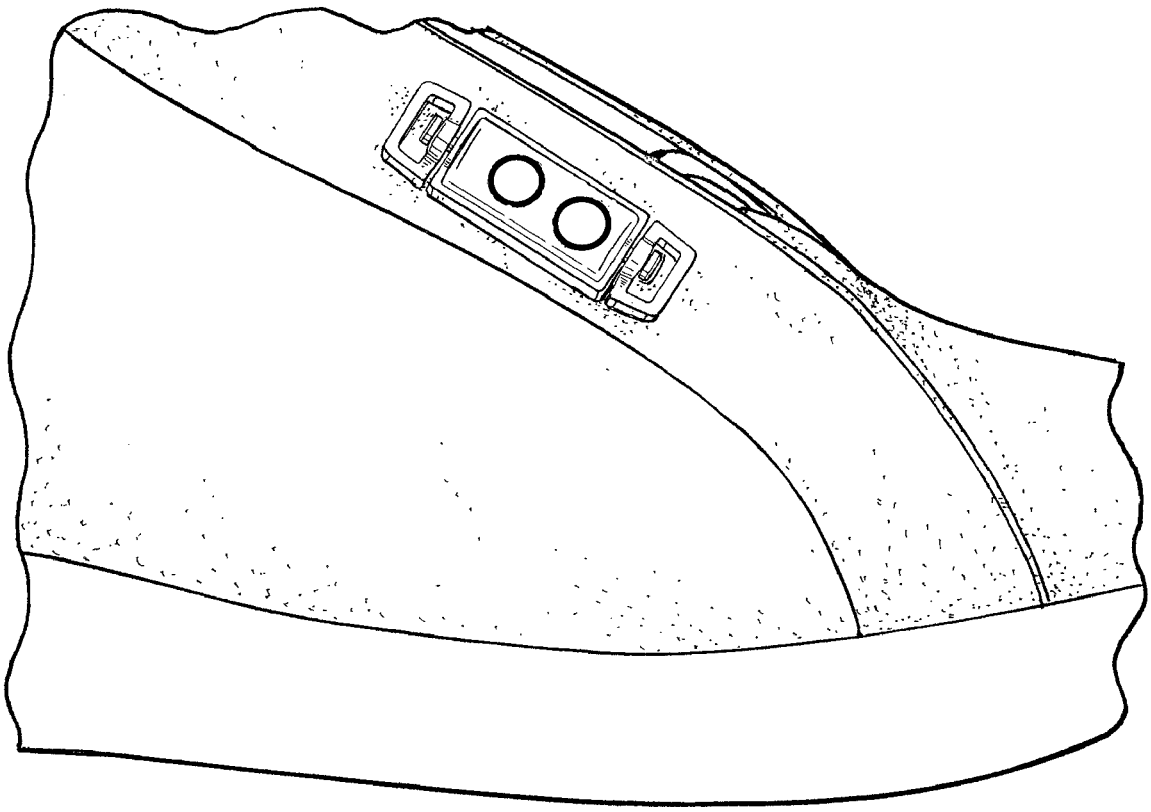
FIG. 11 is an elevational view of a portion of a shoe showing the ornament attached along a side of the eyelet area.
Figure 12:
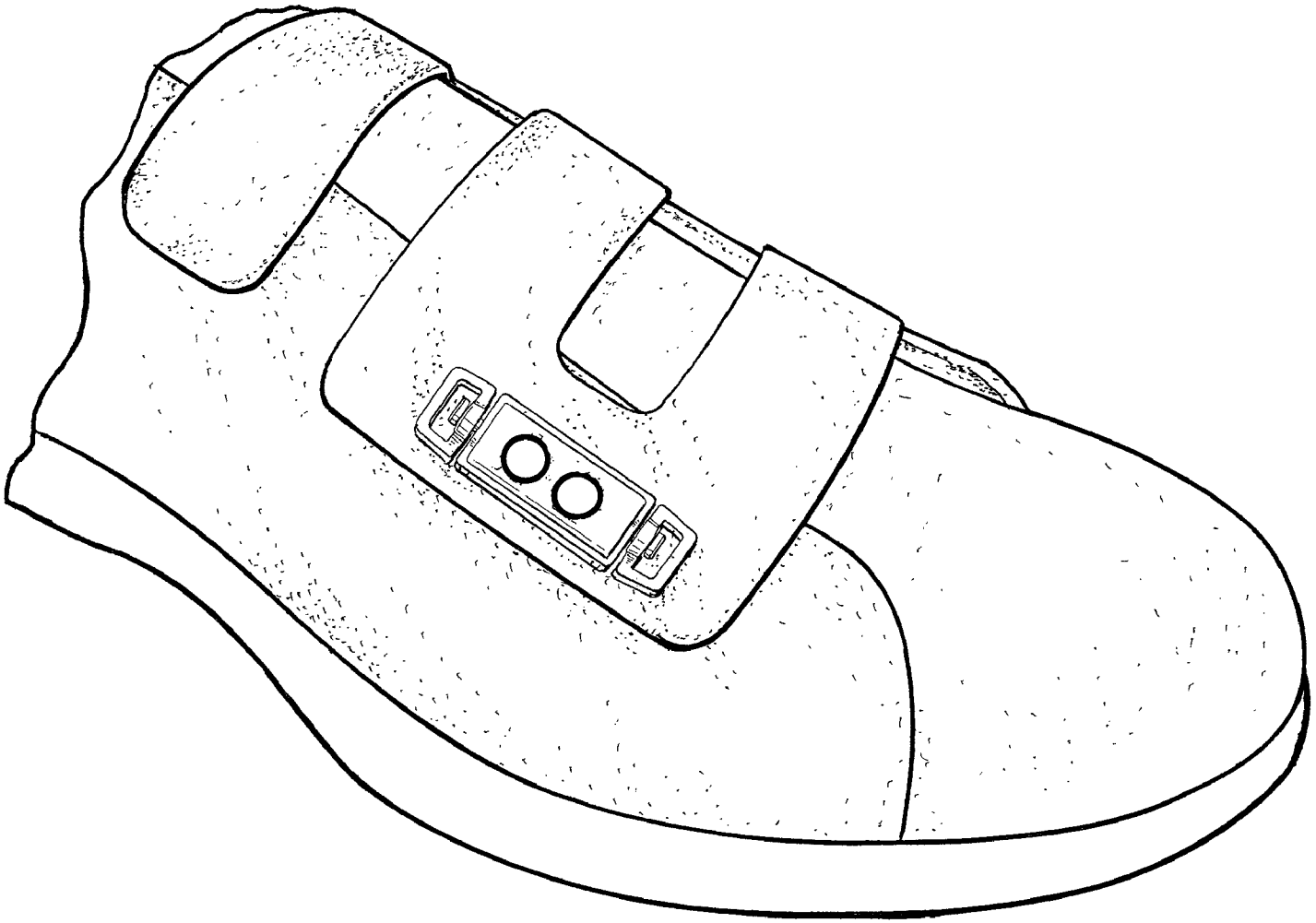
FIG. 12 is a perspective view of a portion of a shoe showing the ornament attached along an alternative closure.
Figure 13:
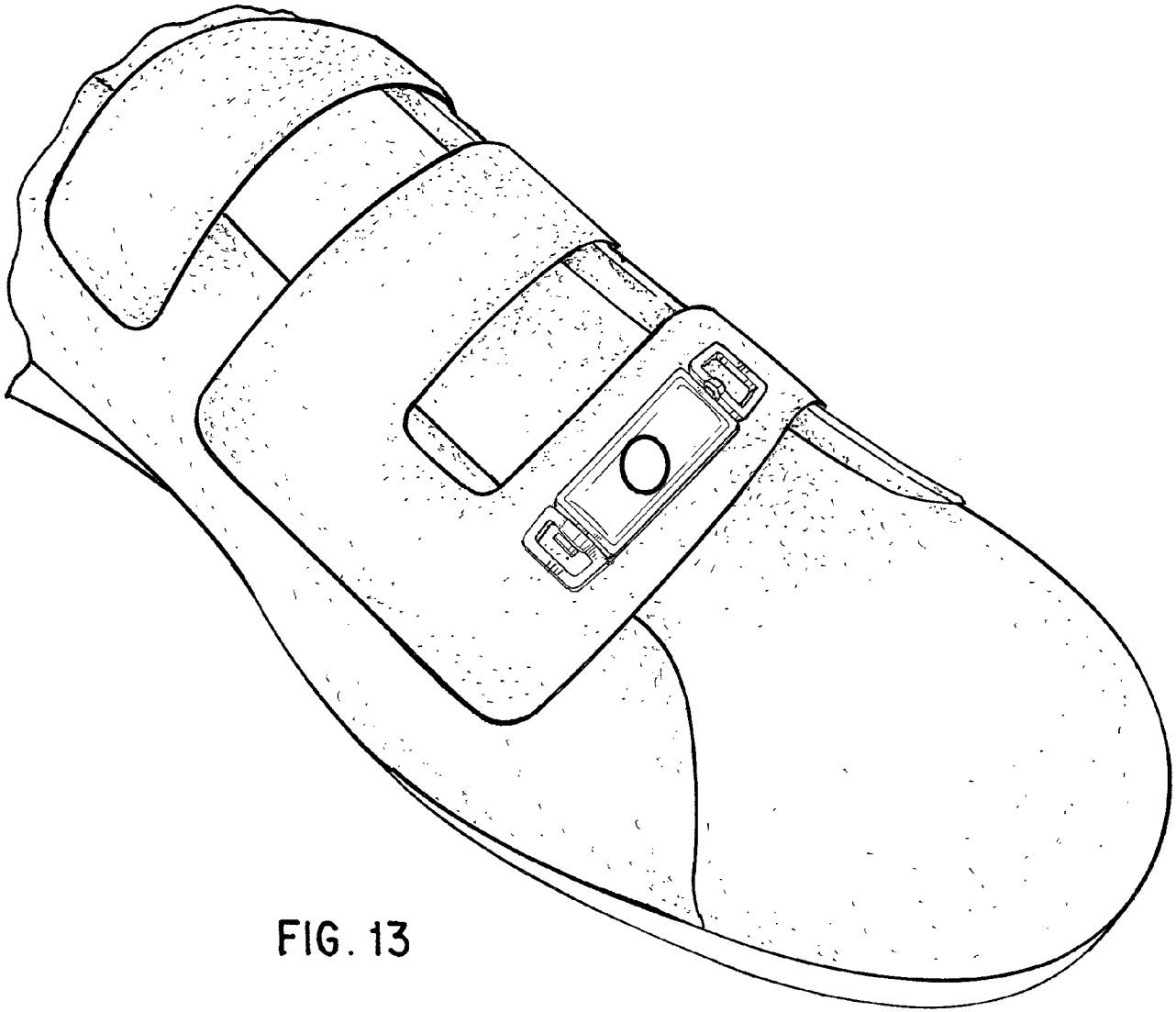
FIG. 13 is a perspective view of a portion of a shoe showing the ornament attached across an alternative closure.

Alternative placements of the ornament are shown in FIGS. 10-13. FIG. 10 shows the ornament attached diagonally across the eyelet area simply by interlacing on the lace between diagonally opposed eyelets. This figure demonstrates the multiplicity of arrangements possible on a laced shoe. FIG. 11 shows the ornament attached along the eyelet area but without use of the shoe lace. The ornament may be attached be adhering the buckles to the shoe upper to remain the rotational freedom of the marquee. It is also possible that a strip of material could be incorporated into the shoe upper for attaching the ornament by interlacing through the buckles. FIGS. 12-13 illustrate a portion of a shoe having an alternative closure. In this case, closure tabs that are generally fastened across the instep by hook-and-loop closures or the like. In this type of lace-less shoe, the ornament can be attached on the closure tab by adhering the buckles or by interlacing onto a strip of material provided for that purpose. FIGS. 12-13 illustrate some possible positions for the ornament on a lace-less shoe.

The illustrated embodiment features a central marquee that has two display faces, however more display faces are well within the scope of the present invention. For example, if central marquee were made thicker, the resulting parallelepiped shape would present four display faces. In addition, a triangular cross-section for central marquee 24 is also possible to present three display faces. The illustrated embodiment shows a single central marquee, but is possible to have multiple central marquees mounted on pin 26 so that they could be independently rotated to provide further permutations of a desired message or visual effect to the ornament.

Although the illustrated embodiment of the eyestay ornament shows a single circle on one display face, and a pair of circles on the opposite display face, these are in no way intended to be limiting. Any combination of words, logos, graphics, colors could be designed onto the display faces to communication any desired message or effect.

While various embodiments of the invention have been described, it will be apparent to those of ordinary skill in the art that may more embodiments and implementations are possible that are within the scope of the invention.

What is claimed is:

1. An eyestay ornament for an article of footwear comprising:

a central, multi-sided rigid marquee rotatably mounted between a pair of buckles, said buckles adapted to receive shoelaces to affix said eyestay ornament to the article of footwear.

2. The eyestay ornament of claim 1, further comprising a pin extending outward from each of two opposite ends of said marquee.

3. The eyestay ornament of claim 2, further comprising a collar integrally formed on each of said buckles to rotatably receive each of said pins.

4. The eyestay ornament of claim 3, wherein said marquee comprises at least two display sides.

5. The eyestay ornament of claim 4, wherein each of said pins comprises an enlarged head to retain said pins in their respective collars.

6. The eyestay ornament of claim 5, wherein each of said collars extends annularly around each of said pins.

7. The eyestay ornament of claim 6, wherein said buckles are D-shaped.

8. The eyestay ornament of claim 1, wherein said multi-sided marquee comprises at least three display faces.

9. The eyestay ornament of claim 1, wherein said multi-sided marquee comprises at least four display faces.

10. The eyestay ornament of claim 1, wherein said multi-sided marquee is configured so as to have a triangular cross-section.

11. An eyestay ornament for an article of footwear comprising:

a central, multi-sided rigid marquee comprising a pin extending outwardly from each of two opposing ends thereof; and a pair of D-shaped buckles, said buckles adapted to receive shoelaces to affix said eyestay ornament to the article of footwear, each of said buckles comprising a collar integrally formed thereon to rotatably receive each of said pins in an annular relation to said pins, wherein each of said pins comprises an enlarged head to retain said pins in their respective collars.

12. An eyestay ornament for an article of footwear comprising:

a central, multi-sided rigid marquee with a pin extending outward from each of two opposite ends thereof, and a pair of buckles, each said buckle comprising an exterior leg and an interior leg defining a space therebetween, each said interior leg having an integrally formed collar to rotatably receive one of said pins of said marquee.

13. The eyestay ornament of claim 12, wherein each of said pins comprises an enlarged head to retain said pins in their respective collars.

14. The eyestay ornament of claim 12, wherein each of said collars extends annularly around each of said pins.

15. The eyestay ornament of claim 13, wherein each of said collars extends annularly around each of said pins.

* * * * *